United States Patent [19]

Sondergeld et al.

[11] Patent Number: 5,046,420

[45] Date of Patent: Sep. 10, 1991

[54] INK DUCT FOR PRINTING PRESSES INCLUDING FANS FOR HEATING INK

[75] Inventors: Werner Sondergeld, Offenbach; Bert Cappel; Gunter Schniggenfittig, both of Muhlheim; Nicola Pupic, Heusenstamm; Valentin Gensheimer, Muhlheim; Georg Hartung, Augsburg, all of Fed. Rep. of Germany

[73] Assignee: MAN Roland Druckmaschinen, Fed. Rep. of Germany

[21] Appl. No.: 557,361

[22] Filed: Jul. 24, 1990

[30] Foreign Application Priority Data

Jul. 28, 1989 [DE] Fed. Rep. of Germany ..... 3925034

[51] Int. Cl.[5] ..... B41F 31/00

[52] U.S. Cl. ..... 101/350; 101/488; 101/335; 101/364; 101/487

[58] Field of Search ..... 101/487, 488, 350, 351, 101/335, 364, 365, 367, DIG. 34

[56] References Cited

U.S. PATENT DOCUMENTS 1,568,382 1/1926 Otten .
2,691,345 10/1954 Huebner ..... 101/364 X
4,152,986 5/1979 Dadowski et al. ..... 101/463

FOREIGN PATENT DOCUMENTS 75716 11/1893 Fed. Rep. of Germany .
10648 6/1951 Fed. Rep. of Germany .
1675538 4/1964 Fed. Rep. of Germany .
1891449 4/1964 Fed. Rep. of Germany .
2328252 1/1974 Fed. Rep. of Germany ..... 101/364
3325005 7/1983 Fed. Rep. of Germany .
150553 11/1981 Japan ..... 101/364

*Primary Examiner*—Edgar S. Burr
*Assistant Examiner*—Eric P. Raciti
*Attorney, Agent, or Firm*—Leydig, Voit & Mayer

[57] ABSTRACT

To obviate local differences in heat expansion in the ink duct, ink metering means and ductor roller, and to temper the printing ink, stabilize the ink-damping agent emulsion and protect the ductor roller from corrosion, the ink duct includes a heat insulating material secured to underside of the duct body and a mid-section portion of the duct body side facing the ductor roller is supplied with a warm air flow from the printing press, boosted by a plurality of fans.

3 Claims, 2 Drawing Sheets

INK DUCT FOR PRINTING PRESSES INCLUDING FANS FOR HEATING INK

FIELD OF INVENTION

The present invention relates generally to printing presses and more particularly concerns an ink duct for supplying ink to a ductor roller in a printing press.

BACKGROUND OF THE INVENTION

Generally speaking, ink ducts for printing presses are widely used and many conventional forms of such ducts are disclosed in the prior art.

In offset printing, the efficiency of production is very dependent on the uniformity of ink metering. Usually, in order to adjust the inking system after pouring in the ink, the side plates of the ink duct are first resiliently brought into engagement with the duct or roller and the ink metering means, consisting of the duct or blade or the ink metering elements, are roughly adjusted with the press rollers stationary (i.e., not rotating).

It is known from practice that the ink feed from the inking system is closely dependent on temperature. Undesired local heating of the ink duct, the metering elements and the ductor roller result in stresses leading to non-uniformity of the ink on the ductor roller, which is difficult for the printer to counteract. These fluctuations in ink metering occur particularly during short breaks in the operation of the press, such as during intervals for washing, stopping or other interruptions in production printing.

In order to solve the problems of temperature fluctuations, it is already known for the inking system (see DE Patent Abstract F 10648, Appl. date: 23.6.51) or the ink duct (see DE Utility Model 1 675 538) or parts of the ink duct (DE-OS 3 325 005) or the ink metering device (DE Utility Model 1 891 449) to be heated or cooled to a predetermined operating temperature in a controlled manner with the press stationary or in operation, in order to reduce the total temperature gradient in the individual components. The resulting heating, depending on the point of application of the heat, also produces limited cancelling-out of thermal expansion, so that the thermal stresses in the ink duct, the metering means and the ductor roller may be minimized to a significant degree. The reduction in stress through thermal expansion results in a reduction in the non-uniformity of the ink on the ductor roller, which is therefore easier to control by the printer.

A disadvantage of the known methods as disclosed above, however, is that an additional adjustable-temperature heat source always has to be installed, which increases the expense and may also be difficult to physically accommodate at the required point of heat application.

OBJECTS AND SUMMARY OF THE INVENTION

The primary object of the invention is to eliminate local differences in thermal expansion in the ink duct, the metering means and the ductor roller of a printing press, without the need to install an additional heat source. Further aims of the invention are to temper the printing ink, to stabilize the ink and damping-agent emulsion, and to protect the ductor roller from corrosion.

Accordingly to the present invention, the ink duct includes heat insulating material secured to the underside and the rear of the ink duct and also a stream of hot air from the printing press, enhanced by fans, is directed on to the side of the ink duct facing the ductor roller and on to the duct metering roller.

The heat insulating material on the underside and rear of the duct reduces troublesome heating of these parts, which are particularly exposed to the stream of hot air from the sheet-guide means in the press.

The side of the ink duct facing the ductor roller is only slightly affected by the hot air from the press, depending on the conditions of installation. This part of the duct is therefore normally at a lower temperature than the rest of the body of the duct. In order to equalize the temperature, according to the present invention the stream of hot air is directed through fans and deflection plates on to the edge of the ink duct on the metering side. This reduces the temperature gradient to below 1°. The low temperature gradient correspondingly reduces the stresses in the bottom part of the ink duct, the metering elements and the ductor roller. As a result, the adjusted ink gap is subjected to fewer fluctuations in thickness, which can be more easily controlled by the printer without need for close temperature regulation or the application of additional heat from an external source.

Besides avoiding thermal expansion as described, the invention also tempers the printing ink and stabilizes the ink and damping-agent emulsion. Since the air from the sheet guide systems of the machine warms up after only a short time in operation, the printing ink is tempered by blowing on to the ductor roller. As a result of tempering during the warming-up phase of the machine, the printing ink has much more uniform viscosity, which is also important for the constant ink feed.

After prolonged operation of the press, the hot-air supply to the ductor roller prevents excessive accumulation of damping agent in the printing ink. An increased content of damping agent can result in corrosion of the ductor roller an ink-metering elements. Thus, there is no need for expensive coatings of corrosion-resistant materials on the ductor roller.

These and other features and advantages of the present invention will become more apparent from the following detailed description when taken in conjunction with the accompanying drawings.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
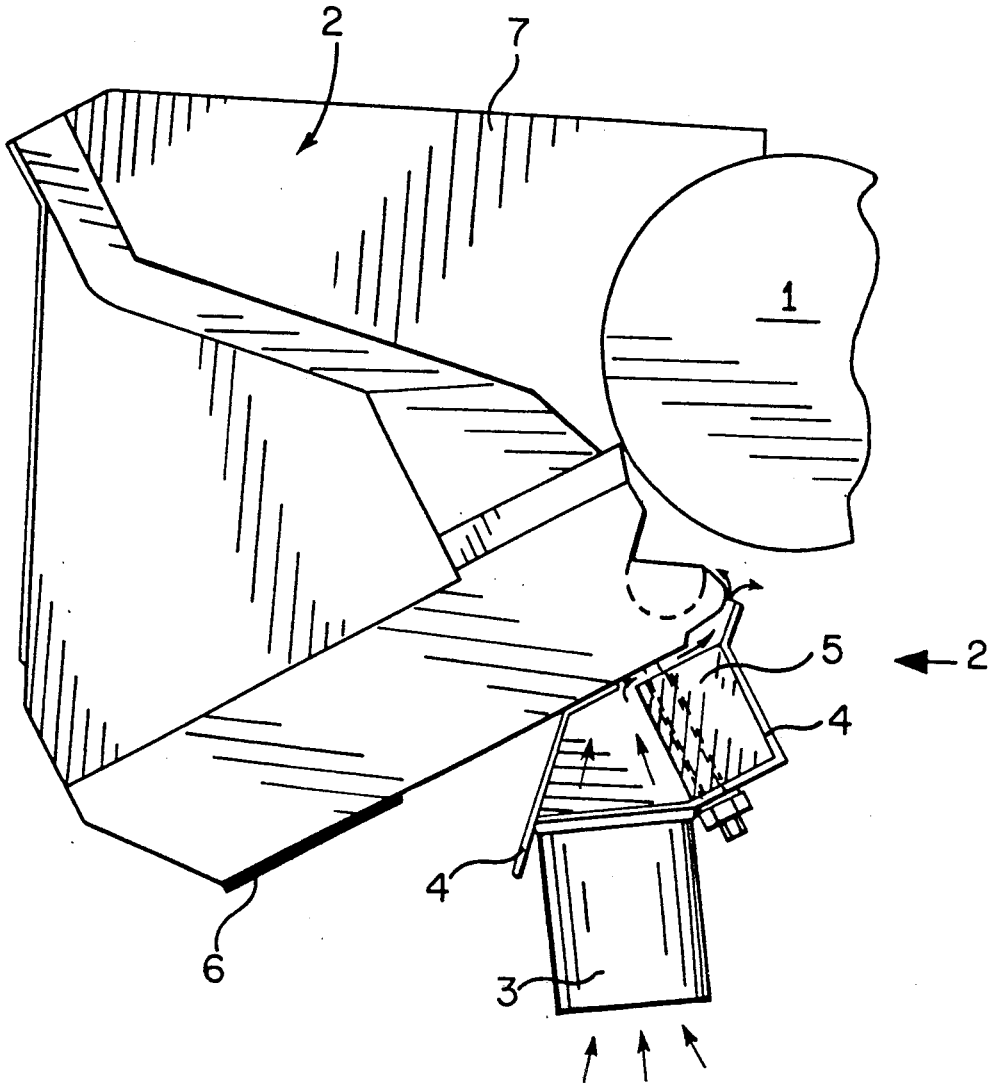
FIG. 1 is a side view of the ink duct and ductor roller.
Figure 2:
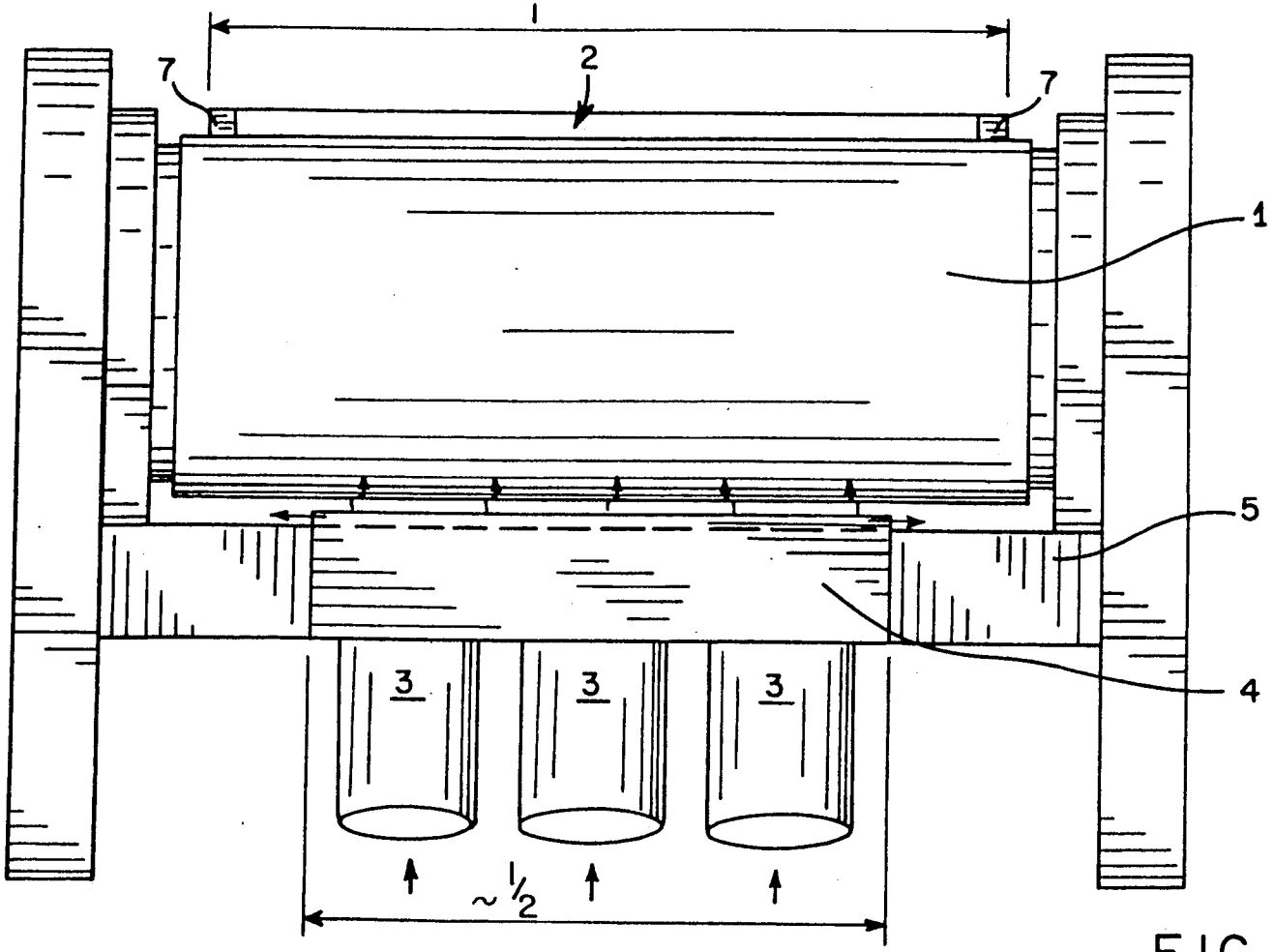
FIG. 2 is a front view of the ink duct and ductor roller as in FIG. 1 taken along view X.

Turning now to the drawings, FIGS. 1 and 2 show an ink duct 2 mounted adjacent a ductor roller 1 in a printing press. The ink duct 2 is secured at both sides to supports which are connected by a cross-member 5 and the duct can be completely slid into the machine on rails (not shown here) on the machine frame. This operating position is defined by abutments (not shown) which limit the sliding-in motion.

Each end face of the ink duct 2 is bounded in known manner by a respective side plate 7 which has a recess which corresponds to and is disposed for engagement with the outer circumferential surface of ductor roller 1. This prevents ink from running out in the region of circumferential contact. Additionally, the ink duct 2 is pivoted towards and away from the ductor roller 1, in conventional manner, such as by a curved lever (not shown) and a pivoting gear.

Pursuant to the present invention the underside of the ductor body is provided with a heat insulating material 6 in order to partially cancel out undue thermal expansion in the ink duct, the metering means (such as a duct blade), and the ductor roller, without the need for additional heat sources. To this end, a mid-section portion equal to substantially one-half the length of the duct body facing the ductor roller 1 is acted upon by heat resulting from a stream of hot air during the time when the press is in operation. Preferably, the stream of hot air is boosted by a plurality of fans 3. In the illustrated embodiment, the fans 3 are disposed near a source of heat produced during the time when the press is in operation, such as under the ink duct 2 and above a sheet-guide drum, so that the stream of hot air from the drum acts on this portion of the ink duct 2 as shown in FIGS. 1 and 2. In order to supply heat substantially without losses and at the high flow rate produced by the fans 3, to the mid-section portion (½) of the length of the duct body facing the ductor roller 1, the fans 3 are surrounded by deflecting blades 4 so that the hot air from the aforementioned mid-section portion (½) is delivered directly at the gap between the ductor roller 1 and the facing side of the ink duct body as shown in FIGS. 1 and 2. In this manner all important parts of the ink duct 2 are exposed substantially uniformly to the flow of hot air.

According to a preferred embodiment of the invention, aluminum-backed styrofoam 3 mm thick is a suitable material 6 for insulation against the stream of hot air. The air path is indicated by arrows in FIGS. 1 and 2 and, as also shown in FIG. 1, the deflecting blades 4 surround the cross-member 5 and leave a gap to the duct body between the deflecting blades and the cross-member. The deflection blades 4 may be secured to the cross-member by a screw.

According to the present invention, an ink duct for supplying ink to a ductor roller of a printing press includes heat insulating material secured to the underside of the ink duct body. Fans are also provided to direct a warm air flow from the printing press to a mid-section portion of the ink duct facing the ductor roller. If desired, the rear end cover of duct 2 can also be insulated by suitable material such as the aluminum-backed styrofoam mentioned above.

We claim as our invention:

1. An ink duct for use on a printing press, said printing press having a ductor roller with a circumferential surface, a metering means for regulating the thickness of an ink layer on said ductor roller, said metering means including a ductor blade extending along the length of said ductor roller, said ink duct comprising:

a duct body, including an underside, a rear portion and a mid-section portion;

side plates connected to the duct body and disposed on the circumferential surface of the ductor roller;

a heat insulating material secured to the underside of the duct body;

means including a plurality of fans for providing an airflow from the printing press toward said duct body, said airflow being of a higher temperature than the ambient air;

said plurality of fans being located at the mid-section portion of said duct body, arranged along the length of said ductor roller, and being positioned to face the ductor roller.

2. An ink duct according to claim 1, wherein said printing press includes at least one heat source which raises the temperature of the ambient air during operation of the printing press, said plurality of fans being disposed between said heat source and said ink duct, and including deflecting means extending around said fans for directing said air flow toward said mid-section portion of said duct body and said ductor roller.

3. An ink duct according to claim 1 including additional heat insulating material secured to said rear portion of said duct body.

* * * * *